US008997346B2

(12) United States Patent
Omae et al.

(10) Patent No.: US 8,997,346 B2
(45) Date of Patent: Apr. 7, 2015

(54) METHOD FOR MANUFACTURING CONNECTOR

(75) Inventors: Takashi Omae, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 222 days.

(21) Appl. No.: 13/582,520

(22) PCT Filed: Apr. 8, 2011

(86) PCT No.: PCT/JP2011/058881
§ 371 (c)(1),
(2), (4) Date: Sep. 4, 2012

(87) PCT Pub. No.: WO2011/129271

PCT Pub. Date: Oct. 20, 2011

(65) Prior Publication Data

US 2013/0019471 A1 Jan. 24, 2013

(30) Foreign Application Priority Data

Apr. 12, 2010 (JP) ..... 2010-091212

(51) Int. Cl.
*H01R 43/20* (2006.01)
*H01R 9/05* (2006.01)
(Continued)

(52) U.S. Cl.
CPC ..... *H01R 9/0518* (2013.01); *H01R 4/34* (2013.01); *H01R 13/514* (2013.01)

(58) Field of Classification Search
USPC ..... 29/592.1, 830, 835, 844; 439/34, 79, 439/86, 91.66, 488, 491, 567, 591, 607.24
See application file for complete search history.

(56) References Cited

U.S. PATENT DOCUMENTS 5,076,806 A * 12/1991 Hotea et al. ..... 439/595
7,137,825 B2 * 11/2006 Myer et al. ..... 439/63
(Continued)

FOREIGN PATENT DOCUMENTS

CN 1264936 A 8/2000
EP 1883135 A1 1/2008
(Continued)

OTHER PUBLICATIONS

International Search Report dated May 17, 2011, issued for PCT/JP2011/058881.
(Continued)

*Primary Examiner* — Paul D Kim
(74) *Attorney, Agent, or Firm* — Locke Lord LLP

(57) ABSTRACT

In order to avoid cost for accommodating a shield wire in a housing while bending, and smoothly and readily accommodate within the housing while the shield electric wire is insulated, a conductive housing 1 including a rear wall 4 continuing to an annular wall 3, and a tube wall 5 continuing to down the rear wall 4, a method comprising the steps of: passing through a shield electric wire 2 from a lower opening 5*a* of the tube wall of the conductive housing to a front opening 3*a* of the annular wall while bending the shield electric wire; putting a shield terminal 9 movably around the shield electric wire from top of the shield electric wire; exposing a core wire 2*b* and a braid 2*a* of the shield electric wire by stripping a tip thereof; connecting an L-shaped terminal 11 to the core wire; mounting an L-shaped insulation inner housing 12 outside the L-shaped terminal; connecting the shield terminal to the braid; and accommodating a vertical part 14 of the inner housing within the conductive housing by pulling in the shield electric wire in an direction contrary to that of the shield electric wire having being passed through, so as to project a horizontal part 13 of the inner housing from the front opening.

6 Claims, 6 Drawing Sheets

(51) Int. Cl.
*H01R 4/34* (2006.01)
*H01R 13/514* (2006.01)

(56) References Cited

U.S. PATENT DOCUMENTS

| | | | | |
|---|---|---|---|---|
| 7,422,480 | B1 * | 9/2008 | Musick et al. | 439/585 |
| 7,597,580 | B1 | 10/2009 | Advey et al. | |
| 2002/0048994 | A1 | 4/2002 | Oota et al. | |
| 2005/0191904 | A1 * | 9/2005 | Fukushima et al. | 439/607 |
| 2008/0026639 | A1 | 1/2008 | Sardi et al. | |
| 2009/0133925 | A1 | 5/2009 | Albert et al. | |
| 2009/0137153 | A1 | 5/2009 | Yoshioka et al. | |
| 2012/0252272 | A1 * | 10/2012 | Omae et al. | 439/607.01 |

FOREIGN PATENT DOCUMENTS

| | | | |
|---|---|---|---|
| JP | 2002-231394 | A | 8/2002 |
| JP | 2003-115357 | A | 4/2003 |
| JP | 2008-034389 | A | 2/2008 |
| JP | 2008-288116 | A | 11/2008 |

OTHER PUBLICATIONS

Office Action dated Apr. 3, 2014, issued for the corresponding Chinese patent application No. 201180004820.2 and English translation thereof.

Supplementary European Search Report dated May 12, 2014, issued for the European patent application No. 11768792.1.

* cited by examiner

METHOD FOR MANUFACTURING CONNECTOR

TECHNICAL FIELD

This invention relates to a method of manufacturing a connector for electromagnetic shield, including assembly process such as connecting a terminal to an electric wire while passing the electric wire through a housing.

BACKGROUND ART

In one conventional configuration, there is described, e.g., in the PTL 1, a connector for transmitting an electric output from or to a receptacle connector, particularly in an automobile, including a divided isolating resin housing composed of a housing main body and a housing cover attachable to the housing main body, wherein a plug of the housing main body is connectable to the receptacle connector, and the electric wire is sloped relative to an area for the electric wire of the housing cover at a position fixable for the electric wire, i.e., the electric wire being bent at right angle.

CITATION LIST

Patent Literature

[PTL 1]
Japanese Patent Application Laid-Open Publication No. 2008-34,389 (FIG. 5)

SUMMARY OF INVENTION

Technical Problem

However, with the connector in the above-mentioned conventional PTL 1, there has been drawback that when accommodating a thick shield electric wire for high voltage within an L-shaped shell conductor or component divisible from side to side, it is difficult to bend in the same shape as the shell conductive member, and there has been concern that any rattles are induced between the shell conductor and the housing cover when a lance or a lock projection is used as a lock, and thereby workability may be reduced of assembling the shell conductor and the housing cover to the housing main body, because provisionally fixing of the shell conductor to the housing cover is made by mounting the lock on a component of the receptacle side after accommodating the shield electric wire within the shell conductor and swaging a shielded conductive of the electric wire.

Accordingly, an object of the invention is, in view of the above, to provide a method of manufacturing a connector that eliminates a work for accommodating the shield electric wire within the housing with the shield electric wire bent, makes a terminal connected to the shield electric wire smoothly and readily accommodated within the housing while insulated, and placed without any rattles within the housing while insulated, and further makes assembling of the connector wholly improved and readily performed.

Solution to Problem

In order to attain the above-mentioned object, there is provided a method for manufacturing a connector having a conductive housing including a rear wall continuing to an annular wall, and a tube wall continuing to down the rear wall, the method comprising the steps of: (a) passing a shield electric wire from a lower opening of the tube wall of the conductive housing to a front opening of the annular wall while bending the shield electric wire; (b) putting a shield terminal movably around the shield electric wire from top of the shield electric wire; (c) exposing a core wire and a braid of the shield electric wire by stripping a tip thereof; (d) connecting an L-shaped terminal to the core wire; (e) mounting an L-shaped insulation inner housing outside the L-shaped terminal; (f) connecting the shield terminal to the braid; and (g) accommodating a vertical part of the inner housing within the conductive housing by pulling the shield electric wire in an direction contrary to that of the shield electric wire passed through, so as to project a horizontal part of the inner housing from the front opening.

The above-mentioned configuration makes it possible to connect the L-shaped terminal to the shield electric wire with the shield electric wire through the conductive housing, to isolate the L-shaped terminal from outside by the inner housing, and to place smoothly and readily the L-shaped inner housing within the conductive housing by pulling out the shield electric wire toward the lower opening side and pulling in the inner housing accommodating the L-shaped terminal within the conductive housing. Preferably, the inner housing is made divisible.

There is provided a method for manufacturing the connector according to the present invention recited in claim 2 characterized about the method recited in claim 1 in that the shield terminal is provided with an annular part brought into connection with the braid, and a plate extending from the annular part and including a projection with a bore, the method further comprising: (i) thread-fastening the shielded terminal to the rear wall of the conductive housing by inserting a bolt through the bore of the projection.

The above-mentioned configuration makes it possible to position the annular part of the shield electric wire near the vertical part of the inner housing, to position the plate along the vertical part, to fasten the projection with the bolt near the vertical part of the inner housing, and thereby, to place, i.e., provisionally fasten the L-shaped terminal within the inner housing without any rattles while accommodated within the inner housing. It is performed by insetting a tool such as a driver from the front opening of the conductive housing to thread-fasten.

There is provided a method for manufacturing the connector according to the present invention recited in claim 3 characterized about the method recited in claim 2 by further comprising: (j) placing an insulation outer housing provided with a conductive shield shell therewithin outside the horizontal part of the inner housing; and (k) bolting a flange of the conductive shield shell and a flange of the outer housing to a flange of the annular wall of the conductive housing.

The above-mentioned configuration makes it possible to fasten the shield shell and the outer housing to each other along with the conductive housing at the same time. The inner housing is preferably fastened by letting its vertical flange sandwiched between the conductive housing and a flange of the outer housing or shield shell. A shell packing, if waterproof required, may be mounted between the conductive housing and the shield shell, or a housing packing between the shield shell and the outer housing.

There is provided a method for manufacturing the connector according to the present invention recited in claim 4 characterized about the method recited in claim 2 by further comprising: (l) putting a wire seal around the shield electric wire before passing the shield electric wire through the conductive housing; (m) moving the wire seal along the shield electric wire after placing the outer housing outside the horizontal part of the inner housing, to put the wire seal within the tube wall of the conductive housing; and (n) holding the wire seal by a holder.

The above-mentioned configuration makes it possible to adhere the wire seal to inside the tube of the conductive housing, and to hold by the holder without dropping out. Thereby, the wire seal can prevent water from infiltrating along the electric wire into the inner housing.

Advantageous Effects of Invention

According to the invention recited in claim 1, it is made possible readily to pass the shield electric wire alone, or nearly in the same fashion, through the conductive housing, and smoothly and readily to accommodate the L-shaped terminal and the inner housing within the conductive housing by directly assembling the L-shaped terminal and the inner housing, and pulling out the shield electric wire. Assembly workability for the connector is thereby improved.

According to the invention recited in claim 2, it is made possible to place the L-shaped terminal within the conductive housing by thread-fastening the shield terminal to the conductive housing without any rattles while insulated by the inner housing. It is thereby improved of workability for post process assembly of components such as the outer housing.

According to the invention recited in claim 3, it is made possible to fix the shield shell and the outer housing to the conductive housing in improved workability. Furthermore, it is made possible to secure the inner housing by, i.e., upon sandwiching and holding at the time the inner housing between the conductive housing and the shield shell.

According to the invention recited in claim 4, it is made possible smoothly and securely to assemble the wire seal along the shield electric wire while positioning and fixing the inner housing of the terminal side of the shield electric wire within the conductive housing and within the outer housing.

BRIEF DESCRIPTION OF DRAWINGS

FIG. 1 is a exploded perspective view illustrating a state of passing an electric wire through a conductive housing in a first step of a method of manufacturing a connector according to the present invention.

DESCRIPTION OF EMBODIMENTS

FIGS. 1 to 14 show one embodiment of a method for manufacturing or assembling a connector according to the present invention.

Figure 1A:
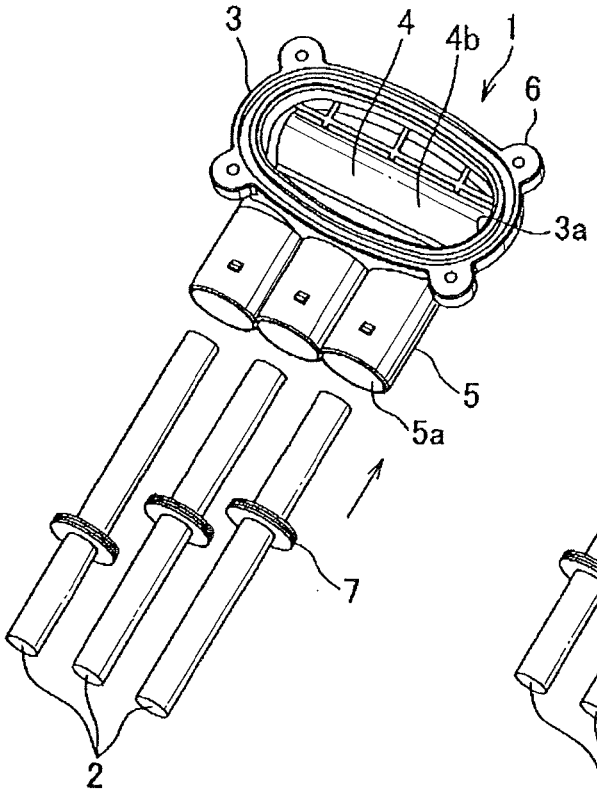
[FIG. 1A]
Figure 1B:
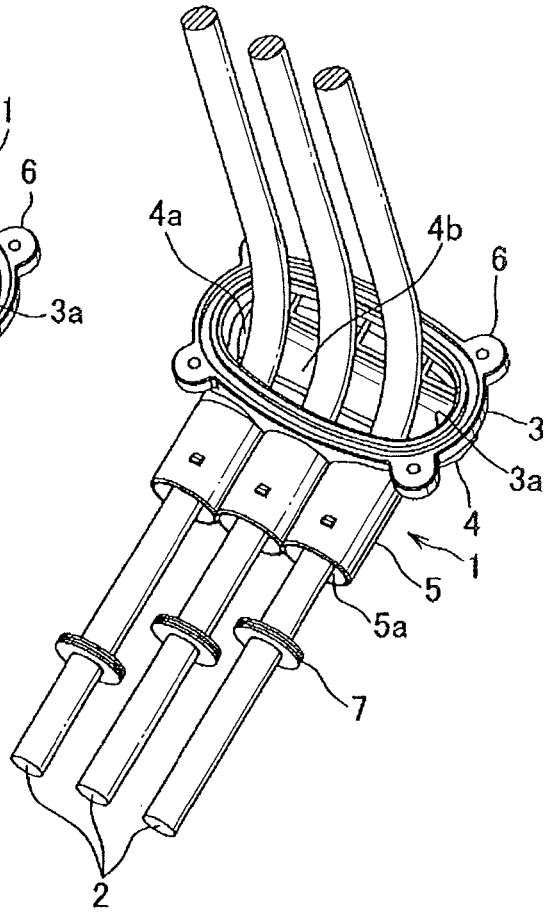
FIG. 1B is a perspective view illustrating a state after passing the electric wire through the conductive housing.

According to the method for manufacturing or assembling the connector, a shield electric wire 2 is, as shown in FIGS. 1A and 1B, first each passed through a metal or aluminum conductive housing 1. The conductive housing 1 is as shown in FIG. 1A, provided with a front annular wall (flange wall) 3, a bulge wall (rear wall) 4 bulging toward and continuing to, back the annular wall integrally (see FIG. 1B), a plurality of tube walls 5 (herein, e.g., three pieces) parallel to each other formed integrally down the bulge wall 4, and a small flange (flange part) 6 projecting vertically the annular wall 3. A vertical through bore 5*a* in the tube wall 5 communicates with a front opening 3*a* of the annual wall 3 through a space 4*a* (FIG. 1B) in the bulge wall 4.

The shield electric wire 2 is conventional one, each provided with an isolating outer cover, a conductive metal braid or shield part inside the outer cover, a isolating inner layer inside the braid, a conductive core wire inside the inner layer, outside the outer cover of which a synthetic rubber wire seal 7 is preliminarily passed trough.

The electric wire 2 is as shown in FIG. 2B, each inserted from a lower opening (substituted by reference sign 5*a*) of the tube wall 5 of the conductive housing, to be passed trough front opening 3*a* of the annular wall 3 through the inner space 4*a* of the bulge wall 4. The electric wire 2 is each smoothly bent in an arc fashion, and smoothly in contact with a slope 4*b* of a guide wall 4 from the inner space 4*a* of the bulge 4 to the front opening 3*a* of the annular wall 3. The slope 4*b* of the bulge 4 is slantwise opposed to an upper opening (not shown) of the tube wall 5. The electric wire is angled within 90-degree (e.g., 45-degree or less). The wire seal 7 is, without engagement with the tube wall 5, positioned down the tube wall 5.

Figure 2:
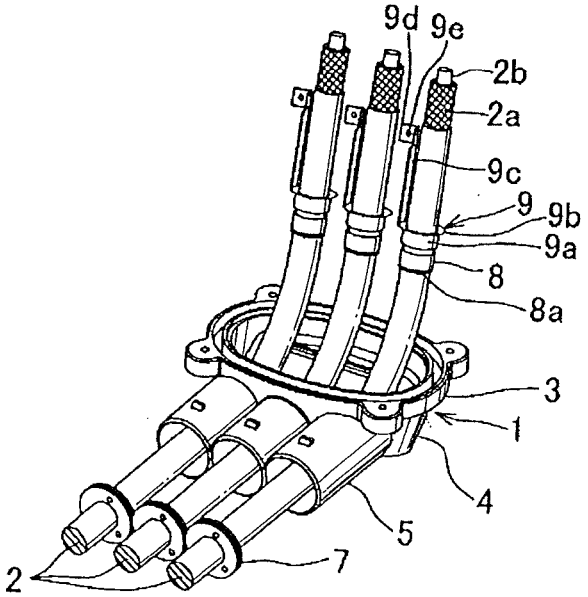
FIG. 2 is a perspective view illustrating a state in which such a shield terminal is put around the electric wire in a second step.

A conductive metal shield sleeve 8 and a conductive metal shield terminal 9 is, as shown in FIG. 2, then sequentially put around each the electric wire 2 (or passing each electric wire through the conductive metal shield sleeve 8 and the conductive metal shield terminal 9), to make a tip (an end) of the electric wire 2 stripped, exposing the braid 2*a* and the core wire 2*b*. The shield sleeve 8 and the shield terminal 9 are arranged movable along the outer cover of the electric wire 2.

The shield sleeve 8 is formed annular, and has a downside flange 8*a* and an upside main body (substituted by reference sign 8). The shield terminal 9 is composed of a annular part

9*a*, an elongated plate 9*c* projecting and extending upwardly from an upside flange 9*b* of the annular part 9*a*, a projection 9*d* with a bore 9*e* orthogonal to and at a tip of the plate 9*c*.

Figure 3:
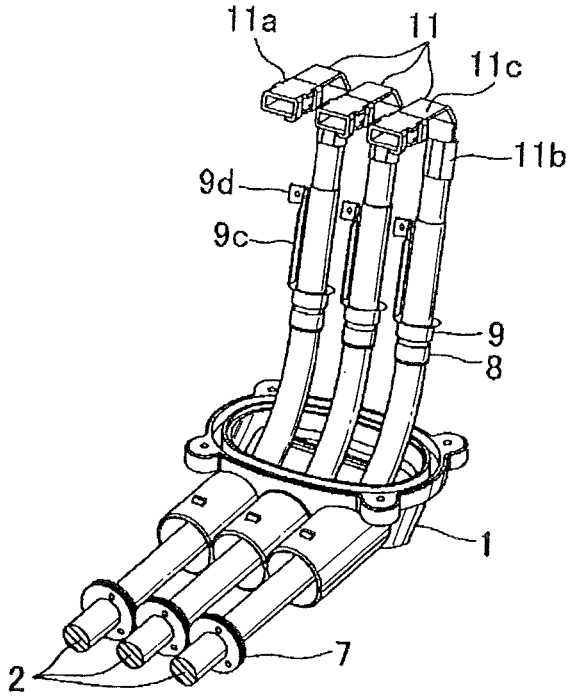
FIG. 3 is a perspective view illustrating a state in which an L-shaped terminal is connected to the electric wire in a third step.

Then, as shown in FIG. 3, the L-shaped terminal 11 is each crimped to connect to the core wire 2*b* of the electric wire 2. The terminal 11 is crimped using such a manual terminal crimping tool (not shown). The L-shaped terminal 11 is composed of an upside parallel male electric contact 11*a*, a downside vertical electric connection part 11*b* (a crimping connection part), and an L-shaped bent plate 11*c* connecting the contact 11*a* and the connection part 11*b*.

Figure 4:
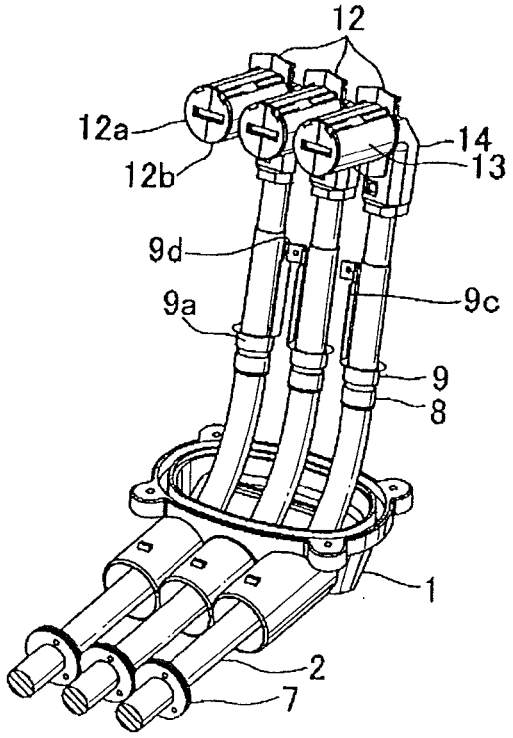
FIG. 4 is a perspective view illustrating a state in which an L-shaped terminal is connected to an inner housing in a forth step.

Then, as shown in FIG. 4, outside the L-shaped terminal an isolating resin inner housing 12 is each mounted. The inner housing 12 is divided into side to side, to accommodate the L-shaped terminal 11 (in FIG. 3), followed by coupling to each other to lock.

Figure 5:
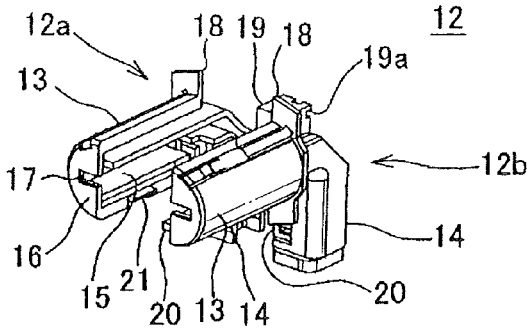
FIG. 5 is an exploded perspective view illustrating one configuration of the inner housing.

The inner housing 12 is as shown in FIG. 5 formed in L-shape divisible side to side, of which divided housings 12*a*, 12*b* each have an upside parallel divided tube 13 in cross-sectionally semicircle shape, a downside vertical divided tube 14 in cross-sectionally rectangle shape, a terminal housing 15 (a slit space) in the divided tubes 13, 14, a parallel mating male terminal inserting bore (slit) 17 disposed at a front wall 16 of the parallel divided tube 13, a vertical flange 18 projected at a rear end of the parallel divided tube 13, a block 19 formed backward a flange 18 of the right side divided tube 12, and lock part such as a lock frame 20 and a lock stop 21.

The block 19 is provided a slit 19*a* brought into positioning and coupling to the conductive housing 1. The inner housing 12 is allowed to be vertically divisible. The divided housing may in this case each be made integral in parallel. A pair of parallel divided tubes 13 is incorporated into the parallel tube (parallel part) 13, a pair of vertical divided tube 14 the vertical tube (vertical part) 14.

Figure 6:
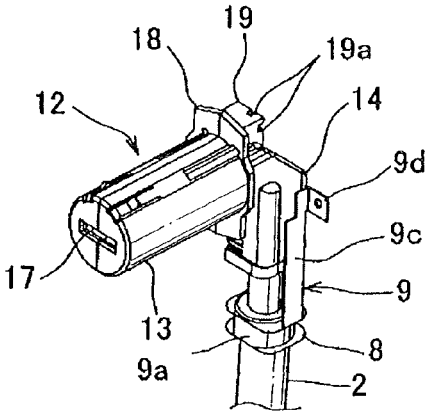
FIG. 6 is an exploded perspective view illustrating an inner housing assembly thereof.
Figure 7:
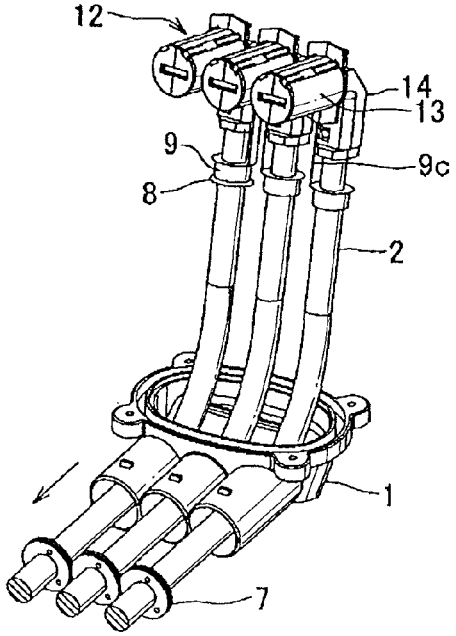
FIG. 7 is a perspective view illustrating a state in which the shield terminal is connected to a braid of the electric wire in a fifth step.

Then, as shown in FIGS. 6, 7, the shield sleeve 8 and the shield terminal 9 are upwardly moved along the electric wire 2, the braid 2*a* of the electric wire 2 is downwardly turned down to overlap on the shield sleeve 8, and the shield terminal 9 is swaged over the overlapping portion of the braid 2*a* to connect. The upwardly extended plate 9*c* of the shield terminal 9 is positioned parallel to the electric wire 2, adjacent to the vertical tube 13 of the inner housing 12.

Figure 8:
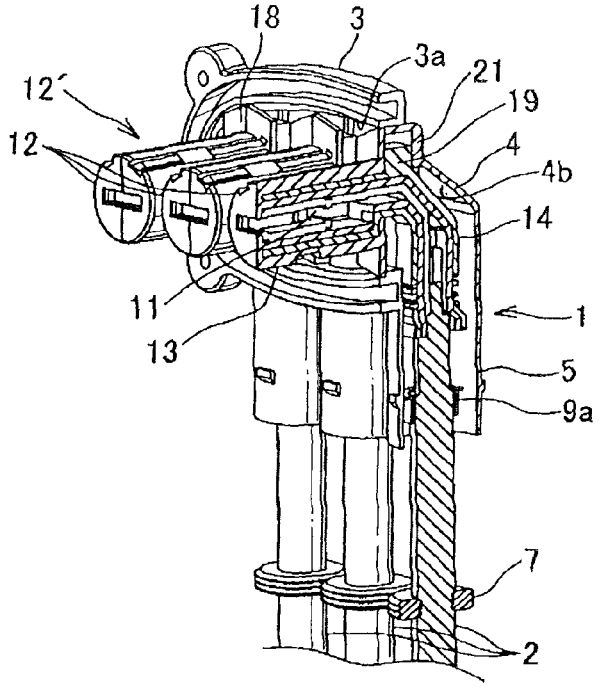
FIG. 8 is a perspective view, which is partially cross-sectioned, illustrating a state in which the inner housing assembly is incorporated within the conductive housing in a sixth step.

Pulling downward the electric wire 2 (a direction contrary to that of inserting the electric wire 2 as shown in FIG. 1) from a state as shown in FIG. 7 allows an inner housing assembly 12' shown in FIG. 8 to be accommodated in the conductive housing 1. The inner housing assembly 12' is composed of the inner housing 12 and the L-shaped terminal 11. The electric wire 2 is, from a state as shown in FIG. 7, smoothly contacted with inside the tube 5 of the conductive housing 1 or inner circumference of the annular wall 3. The inner housing assembly 12' is smoothly pulled in from the vertical tube 14 into the conductive housing 1.

The block 19 back the inner housing 12 is as shown in FIG. 8 contacted with a wall face 21 in the bulge 4 of the inner housing 1, leading to prevention of further pulling in. The vertical tube 14 of the inner housing 12 is accommodated in the bulge 4 and the tube wall 5, making the parallel tube 13 project from the front opening 3*a* of the annular wall 3. The reference sign 11 in FIG. 8 indicates the L-shaped terminal. The shield terminal 9 is accommodated in the tube wall 5.

Figure 9:
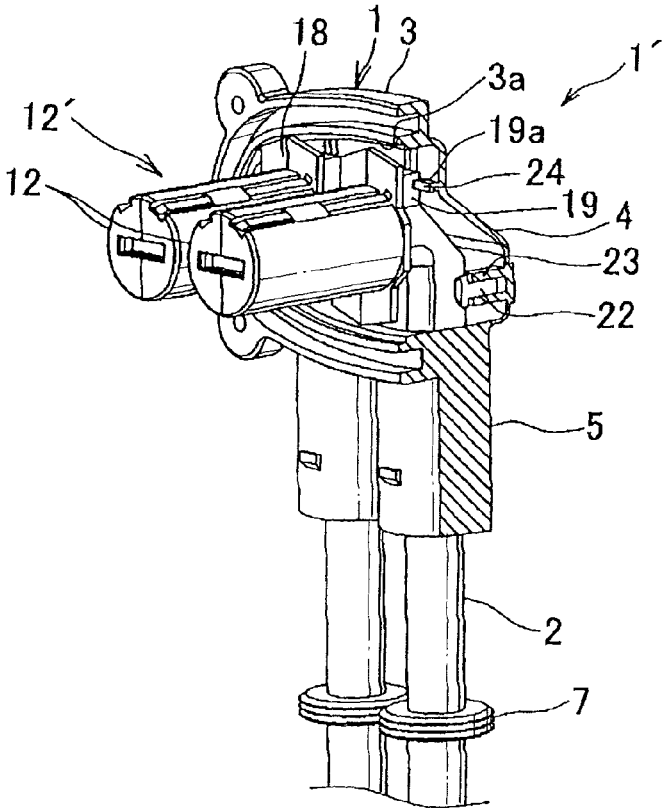
FIG. 9 is a perspective view, which part is partially cross-sectioned, illustrating a state in which the inner housing assembly is fixed to the conductive housing in a seventh step.

Then, as shown in FIG. 9, by inserting a bolt 22 from the opening 3*a* of the annular wall 3 into the 9*e* in the projection 9*d* at upper end of the plate 9*c* of the shield terminal (FIG. 7), and installing into a threaded bore in the bulge (rear wall) 4 of the conductive housing 1, the shield terminal 9 is fixed to the conductive housing 1. The above operation makes it easy to fix the inner housing assembly 12' integral with the shield terminal 9 to the conductive housing 1. The threaded bore is formed inside the parallel tube 23 in the bulge 4.

While the projection 9*d* of the shield terminal 9 of leftmost the electric wire 2 in the FIG. 3 is located left, turning around as shown in FIG. 4, i.e., rotating 180-degree the annular part 9*a* allows both the shield terminals 9 to be fixed with one bolt 22 shown in FIG. 9 to the conductive housing 1 upon overlapping the projection 9*d* of the shield terminal 9 of leftmost the electric wire 2 with that of center the electric wire 2. Since the projection 9*d* is located widthwise center the plate 9*c*, the shield terminal 9 is allowed to use in reverse.

The slit 19*a* back the block 19 of the inner housing 12 is as shown in FIG. 9 positioned to engage with the parallel rib 24 in the bulge 4 of the conductive housing 1. The vertical flange 18 of the inner housing 12 is pressed down by a flange of the outer housing to be described hereinafter. The conductive housing 1 and the inner housing 12' compose the conductive housing assembly 1'.

Figure 10:
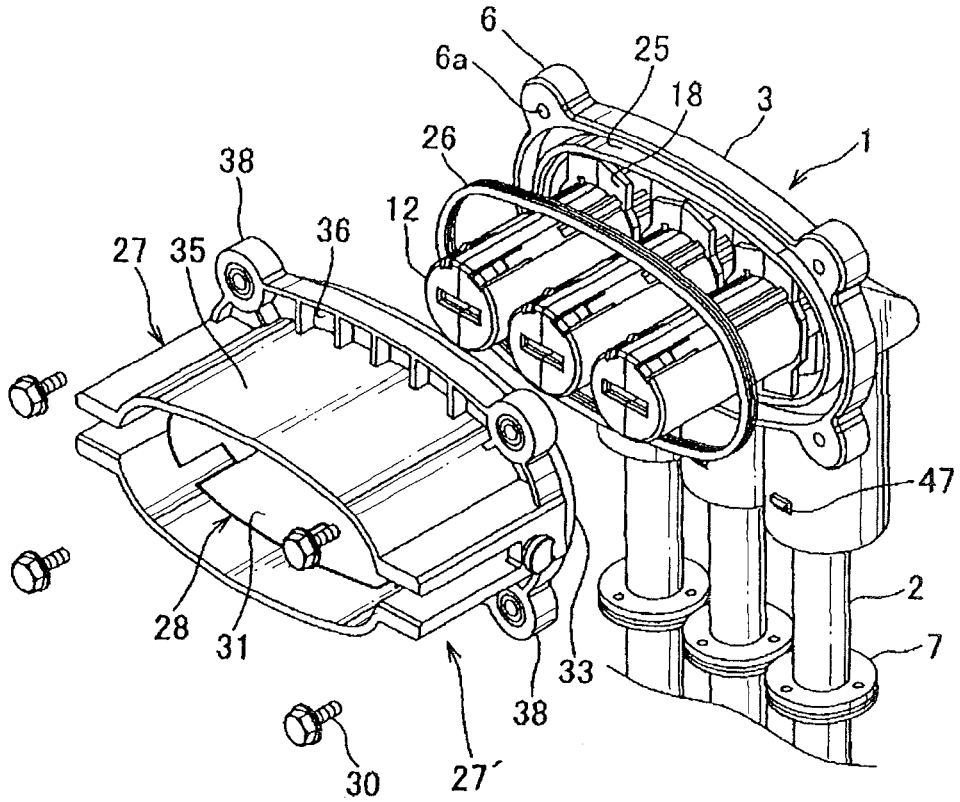
FIG. 10 is an exploded perspective view illustrating a state in which such the outer housing assembly is mounted on the conductive housing in an eighth step.

Then, as shown in FIG. 10, an oblong circumference slit 25 front the annular wall 3 of the conductive housing 1 is packed with a shell packing 26, from above which an isolating resin outer housing 27 (also referred to as a front housing) and a assembly or outer housing assembly 27' composed of a conductive metal shield shell 28 and a housing packing 29 are assembled to the conductive housing 1, to be thread fastened with a bolt 30.

Figure 11:
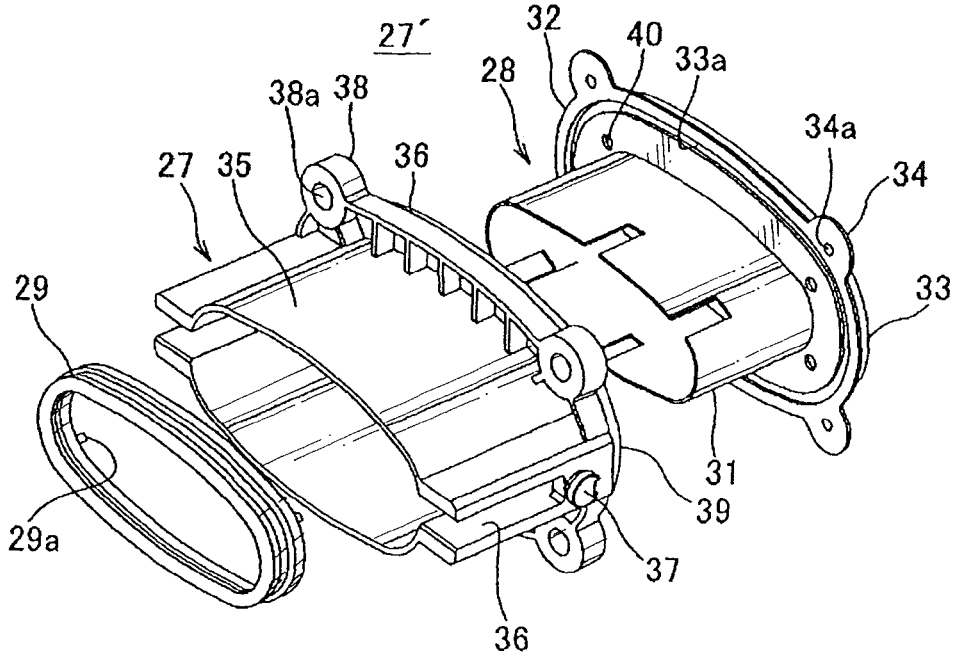
FIG. 11 is an exploded perspective view illustrating one configuration of the outer housing assembly.

The shield shell 28 is, as shown in FIG. 11, composed of an oblong parallel tube 31, and a vertical flange 32 back the tube 31, which the flange 32 includes an annular projection 33 bulging backward and a small outward flange 34 with a bore. The outer housing 27 is composed of an oblong parallel main body 35 and a vertical flange 36 back the main body 25, both sides of the main body 35 are cut away in a slit shape, and backward the slit 36 an axis 37 is projected. The flange 36 includes a small flange 38 with a bore. Backward the flange 36 an annular projection 39 adapted to engage with the circumference slit 33*a* of the shield shell 28 is disposed.

The housing packing 29 has a lock projection 29*a* engaging with the bore 40 of the flange 32 of the shield shell 28, and mounted outside the tube 31. The annular projection 33 of the shield shell 28 is positioned to be pressed into the circumference slit 25 of the conductive housing 1 (FIG. 10) along with the shell packing 26 (outside or inside of the shell packing 26). The flange 36 of the outer housing 27 and the flange 32 of the shield shell 28, overlapping front and rear to each other, press backward the flange 18 shown in FIG. 10 of the inner housing 12 in the conductive housing 1, to sandwich and fix between a wall of the bulge wall 4 and themselves.

Figure 12:
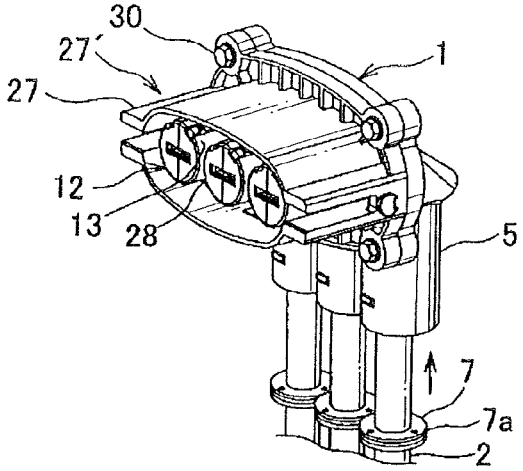
FIG. 12 is a perspective view illustrating a state in which a wire seal is mounted on the conductive housing in a ninth step.

Overlapping the small flanges 38, 34 of the outer housing 27 and the shield shell 28, respectively, as shown in FIG. 10, the bolt 30 is inserted into the small flanges 38*a*, 34*a*, and is thread fastened to the thread bore 6*a* of the small flange 6 of the conductive housing 1, letting the outer housing assembly 27' to be fixed to the conductive housing 1 as shown in FIG. 12.

The parallel tube 13 of the inner housing 12, as shown in FIG. 12, is inserted into the tube 31 of the shield shell 28 along its inside, and is positioned within inside space of the outer housing 27. Then, the wire seal 7 is moved as shown in FIG. 12, upward along the electric wire 2 such that its outside lip 7*a* is inserted into the vertical tube wall 5 of the conductive housing 1 in close contact therewith. The inside lip of the wire seal 7 is in close contact with the outer cover of the electric wire 2.

Figure 13A:
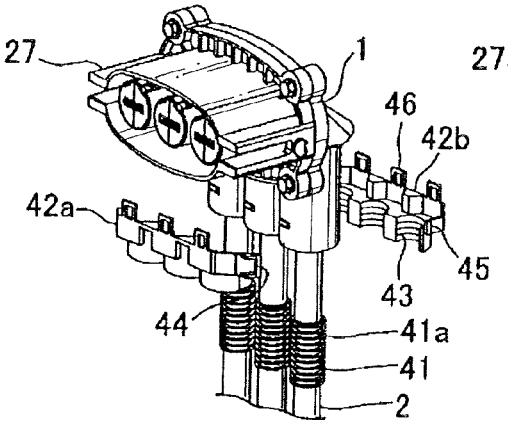
FIG. 13A is an exploded perspective view illustrating a state in which a rear holder is mounted on the conductive housing in a tenth step.
Figure 13B:
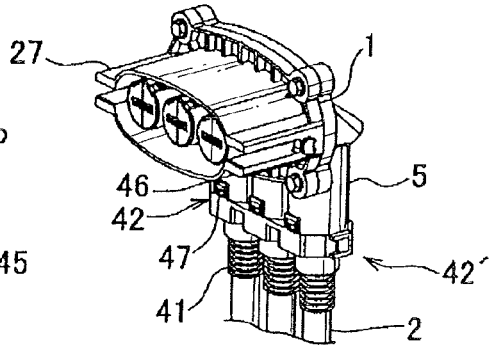
FIG. 13B is a perspective view illustrating a state after the rear holder is mounted.

Then, a pair of front and rear divided holders 42*a*, 42*b*, as shown in FIGS. 13A, 13B, is assembled outside a synthetic resin short (or long) corrugated tube 41 attached to the electric wire 2, and a circumference projection strip 43 in each of the divided holders 42*a*, 42*b* is engaged with a circumference slit 41*a* of the corrugated tube 41 while each of the divided holders 42*a*, 42*b*, is locked in each other with a projection 44 and a lock means such a lock frame 45, to be assembled as a rear holder or holder 42. A rear holder assembly 42' composed of the rear holder 42*a* and the corrugated tube 41 is pulled up along the electric wire 2, and an upward lock frame 46 of the rear holder 42 is engaged with a projection downside the tube wall 5 of the conductive housing 1, shown in FIG. 10. The rear holder 42 is adapted to prevent the shield seal 7, shown in FIG. 12, from dropping out.

Figure 14:
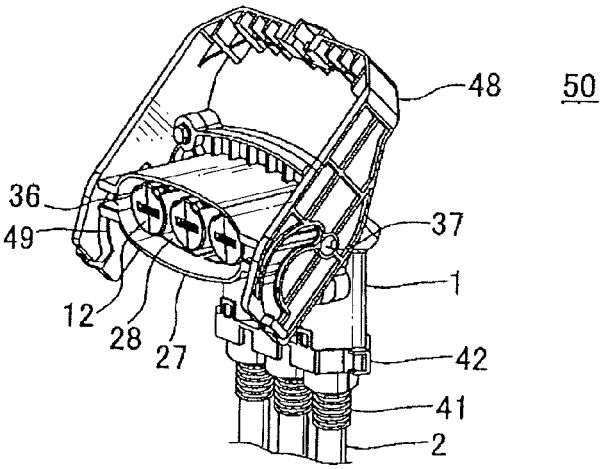
FIG. 14 is a perspective view illustrating a state in which a lever is mounted on the outer housing in a eleventh step.

Then, nearly U-shaped lever 48 for low-insertion-force engagement is as shown in FIG. 14 assembled to the axis 37 of the outer housing 27, completing a connector 50, i.e., shield waterproof connector. The lever 48 is provided with a cam bore 49 adapted to engage with a driven projection (not shown) of a mating connector entering into the slit 36 of the outer housing.

Note that while in the above-mentioned embodiment the shield sleeve 8 has been utilized, it may be made possible that the annular wall 9*a* of the shield terminal 9*a*, avoiding the shield sleeve 8, is directly swaged and connected to the braid 2 of the electric wire 2. "The shield terminal" in claim 1 includes the one with or without a shield sleeve 8.

Further, note that while in the above-mentioned embodiment the shell packing 29, the housing packing 26, and the cable seal 7 have been utilized, it may be made possible to avoid these shield member if no need of waterproof. And in the above-mentioned embodiment the lever 48 for connector engagement has been mounted, it is made possible to avoid the lever 48 when manually connecting the connector 50 to the mating connector without the lever.

INDUSTRIAL APPLICABILITY

The method for manufacturing the connector according to the present invention may be utilized for readily assembling the electromagnetic shield connector.

REFERENCE SIGNS LIST

1 conductive housing
2 shield electric wire
2*a* braid
2*b* core wire
3 annular wall
3*a* front opening
4 bulge wall (rear wall)
5 tube wall
5*a* lower opening
6 small flange (flange part)
7 wire seal
9 shield terminal
9*a* annular part
9*c* plate
9*d* projection
9*e* bore
11 L-shaped terminal
12 inner housing
13 parallel tube (parallel part)
14 vertical tube (vertical part)
22 bolt
27 outer housing
28 shield shell
32, 36 flange
42 rear holder (holder)
50 connector

The invention claimed is:

1. A method for manufacturing a connector having a conductive housing including a rear wall continuing to an annular wall, and a tube wall continuing to down the rear wall, the method comprising the steps of:

(a) passing a shield electric wire from a lower opening of the tube wall of the conductive housing to a front opening of the annular wall while bending the shield electric wire;

(b) putting a shield terminal movably around the shield electric wire from top of the shield electric wire;

(c) exposing a core wire and a braid of the shield electric wire by stripping a tip thereof;

(d) connecting an L-shaped terminal to the core wire;

(e) mounting an L-shaped insulation inner housing outside the L-shaped terminal;

(f) connecting the shield terminal to the braid; and (g) accommodating a vertical part of the inner housing within the conductive housing by pulling the shield electric wire in an direction contrary to that of the shield electric wire passed through, so as to project a horizontal part of the inner housing from the front opening.

2. The method according to claim 1, wherein the shield terminal is provided with an annular part brought into connection with the braid, and a plate extending from the annular part and including a projection with a bore, the method further comprising:

(i) thread-fastening the shielded terminal to the rear wall of the conductive housing by inserting a bolt through the bore of the projection.

3. The method according to claim 2 further comprising:

(j) placing an insulation outer housing provided with a conductive shield shell therewithin outside the horizontal part of the inner housing; and (k) bolting a flange of the conductive shield shell and a flange of the outer housing to a flange of the annular wall of the conductive housing.

4. The method according to claim 3 further comprising:

(l) putting a wire seal around the shield electric wire before passing the shield electric wire through the conductive housing;

(m) moving the wire seal along the shield electric wire after placing the outer housing outside the horizontal part of the inner housing, to put the wire seal within the tube wall of the conductive housing; and (n) holding the wire seal by a holder.

5. The method according to claim 1, wherein the shield electric wire is passed from the lower opening of the tube wall of the conductive housing to the front opening of the annular wall while the shield electric wire is bending along a slope of the rear wall.

6. The method according to claim 1, wherein the vertical part of the inner housing within the conductive housing is pulled by the shield electric wire from the lower opening of the tube wall of the conductive housing.

* * * * *